US006809624B2

(12) United States Patent
Coates

(10) Patent No.: US 6,809,624 B2
(45) Date of Patent: Oct. 26, 2004

(54) INTEGRATED BOBBIN TRANSFORMER ASSEMBLY

(75) Inventor: Brian D. Coates, Morro Bay, CA (US)

(73) Assignee: Rantec Power Systems, Inc., Los Osos, CA (US)

( * ) Notice: Subject to any disclaimer, the term of this patent is extended or adjusted under 35 U.S.C. 154(b) by 0 days.

(21) Appl. No.: 10/352,612

(22) Filed: Jan. 28, 2003

(65) Prior Publication Data

US 2004/0145440 A1 Jul. 29, 2004

(51) Int. Cl.[7] ..... H01F 5/00
(52) U.S. Cl. ..... 336/200; 336/223; 336/232; 336/192; 336/83
(58) Field of Search ..... 336/200, 232, 336/223, 192, 83, 180, 182, 198

(56) References Cited

U.S. PATENT DOCUMENTS 6,353,379 B1 * 3/2002 Busletta et al. ..... 336/200
6,380,834 B1 * 4/2002 Canzano et al. ..... 336/200
6,429,763 B1 * 8/2002 Patel et al. ..... 336/200

* cited by examiner

*Primary Examiner*—Lincoln Donovan
*Assistant Examiner*—Jennifer A. Poker
(74) *Attorney, Agent, or Firm*—Hickman Palermo Truong & Becker LLP

(57) ABSTRACT

An integrated bobbin transformer assembly includes a first planar assembly, a second planar assembly, and a connecting assembly. The first planar assembly includes a first winding. In one embodiment of the invention, the second planar assembly includes an additional first winding. The connecting assembly is integrated into the first planar assembly and the second planar assembly. The connecting assembly includes a second winding. A magnetic core magnetically couples a voltage from the second winding to the first winding. In an embodiment of the invention, the magnetic core magnetically couples a voltage from the second winding to the first winding and the additional first winding.

14 Claims, 5 Drawing Sheets

Power Supply 100

Integrated Bobbin Transformer Assembly 200

Integrated Bobbin Transformer Assembly 200

Layer 4, Layer 5 Core & Buried Holes

Layer 2, Layer 3 Core & Buried Holes

INTEGRATED BOBBIN TRANSFORMER ASSEMBLY

BACKGROUND

1. Technical Field

Embodiments of the present invention generally relate to a transformer assembly. More particularly, embodiments of the present invention relate to an integrated bobbin transformer assembly.

2. Discussion of the Related Art

Electronic product manufacturers are encountering ever-increasing demand to reduce the size and weight, and to increase the efficiency of their products. An electronic product's power supply is often the largest and heaviest components of the product, and also the largest source of power loss.

To address this problem, some transformer manufacturers have begun to produce low-profile planar, or printed circuit board (i.e., PCB) style transformers. In low-profile planar transformers, the primary windings, which are a spiral of traces on a planar surface, are coupled to the secondary windings, which are a different spiral of traces on a separate planar surface, by enclosing the windings in a magnetic housing. Typically, the magnetic housing is made of ferrite, Sumarium, or some other composite material, which may be shaped as a pot-core, an R-M core, an E core, or an I core, for example. However, the housing may be almost any shape that is easy to place around the windings and that effectively confines the magnetic field to the area around the windings.

The use of planar traces, rather than classical wire windings, on a bobbin is a significant manufacturing advance for high-frequency transformers.

Furthermore, conventional transformers have multiple bobbins. For example, the primary windings and the secondary windings generally require at least one bobbin each to ensure that the windings do not unwind. The use of multiple bobbins in transformers adds size and results in poor coupling within the transformer. Moreover, due to size restraints, the use of multiple bobbins generally limits the number of windings that may be placed within a transformer and/or the size of the wire used to make the windings.

DETAILED DESCRIPTION

Reference in the specification to "one embodiment", "an embodiment", or "another embodiment" of the present invention means that a particular feature, structure or characteristic described in connection with the embodiment is included in at least one embodiment of the present invention. Thus, the appearances of the phrase "in one embodiment" or "according to an embodiment" appearing in various places throughout the specification are not necessarily all referring to the same embodiment. Likewise, appearances of the phrase "in another embodiment" or "according to another embodiment" appearing in various places throughout the specification are not necessarily referring to different embodiments.

Figure 1:
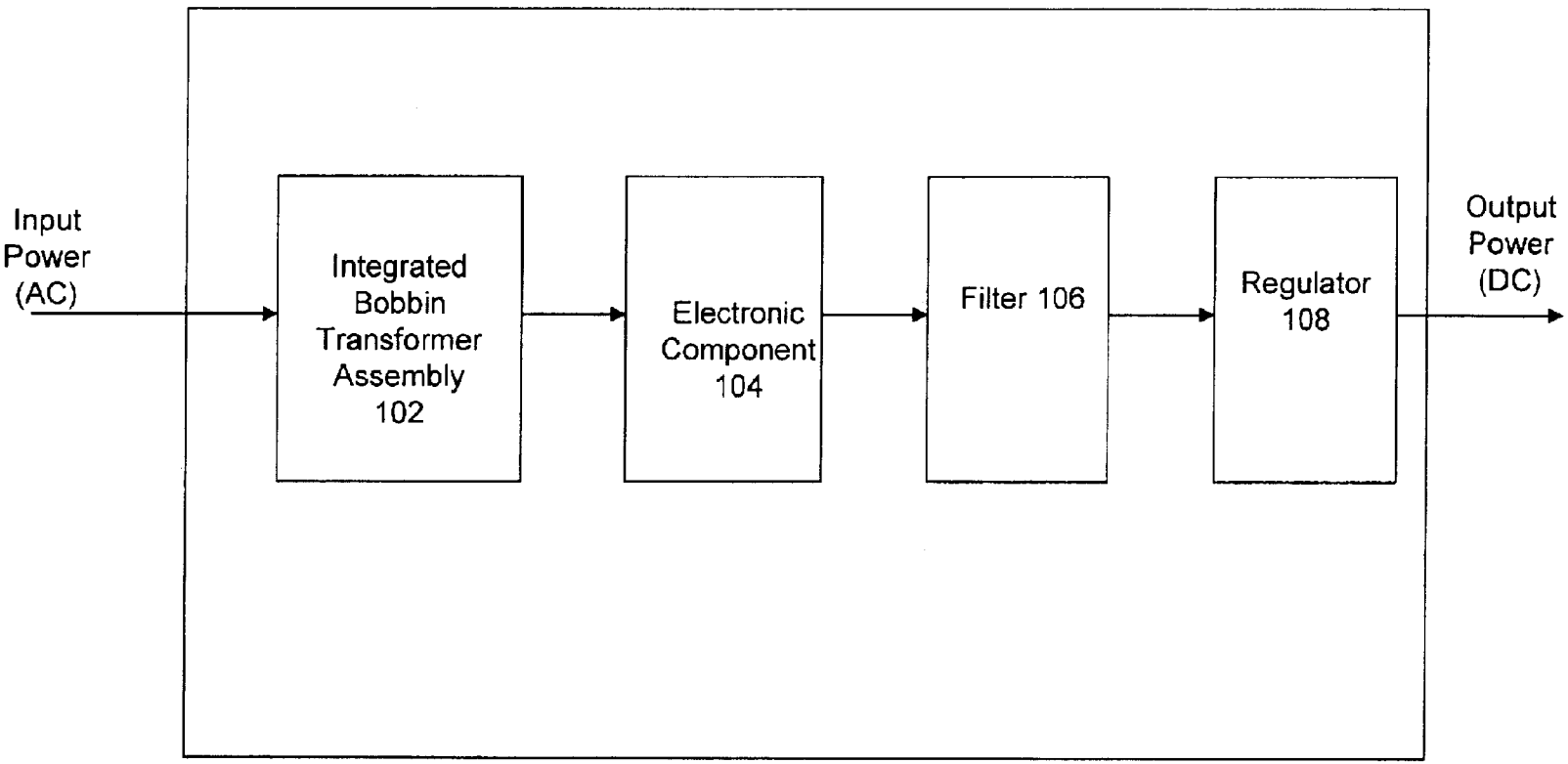
FIG. 1 illustrates a power supply according to an embodiment of the present invention.

FIG. 1 illustrates a power supply according to an embodiment of the present invention. An electronic device may need to receive a direct current (DC) voltage and may include a power supply 100 to convert an alternating current (AC) voltage to a DC voltage. The power supply 100 may include an integrated bobbin transformer assembly 102, an electronic component 104, a filter 106, and a regulator 108. The electronic component 104 may be a rectifier or a power field effect transistor (FET). The integrated bobbin transformer assembly 102 may step the input voltage either up or down, depending on the voltage needs of the electronic device.

Because the bobbin of the integrated bobbin transformer assembly 102 is integrated together with a first planar assembly (not shown) and a second planar assembly (not shown), the integrated bobbin transformer assembly 102 provides better coupling between a primary winding and a secondary winding due to the omission of a separate bobbin assembly. Extra space is also realized with an integrated bobbin transformer assembly 102, and this allows the wire gauge diameter size of the winding wrapped about a connecting assembly (not shown), whether the winding about the connecting assembly is the primary winding or the secondary winding, to be increased. The increase in the wire gauge diameter size of the winding of the transformer, whether it is the primary winding or the secondary winding, may minimize the power losses of the integrated bobbin transformer assembly 102. In addition, a more efficient electronic component, e.g., rectifier or power FET, 104 may be utilized in the power supply 100 if an integrated bobbin transformer assembly 102 is utilized, which also leads to reduced losses within the power supply 100. Finally, the windings, whether primary or secondary, integrated into the first planar assembly (not shown) or the second planar assembly (not shown) may include twice or more the amount of material, which also reduces the loss of the integrated bobbin transformer assembly 102.

The output from the integrated bobbin transformer assembly 102 may be input to the electronic component 104 to create a stepped up or stepped down voltage. The output of the electronic component 104 may be input to a filter 106, where the electronic component output is smoothed and the voltage then becomes a voltage with either a positive or negative polarity to ground. The output of the filter 106 may then be input to a regulator 108 to ensure that a specific voltage is input to the electronic device.

The integrated bobbin transformer assembly 102 is not limited to applications including power supplies. Any application where magnetic coupling is needed may utilize the integrated bobbin power transformer assembly 102, specifically applications where a small footprint is required and a highly efficient magnetic coupling is desired.

Figure 2:
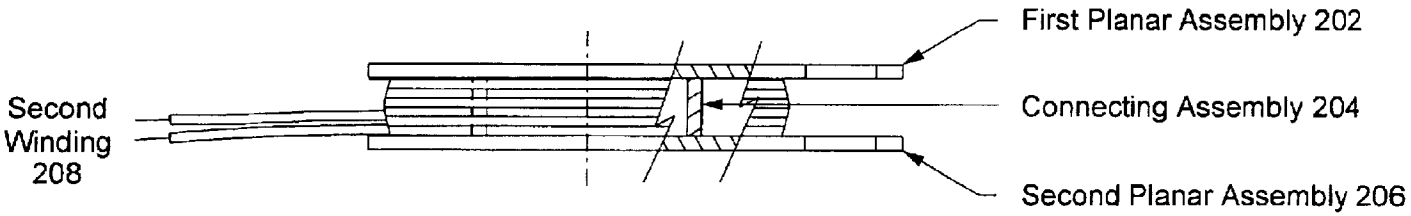
FIG. 2 illustrates an integrated bobbin transformer assembly according to an embodiment of the present invention.
Figure 2A:
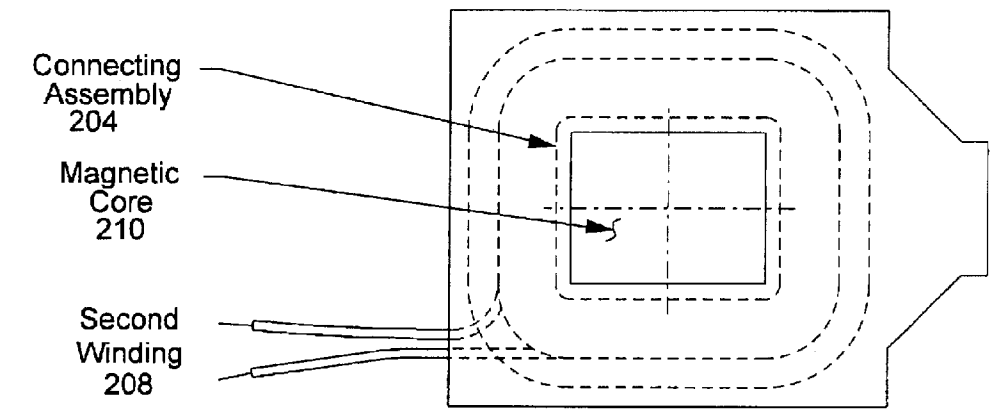
FIG. 2*a* illustrates placement of a magnetic core and a second winding in an embodiment of the present invention.

FIGS. 2 and 2*a* illustrate an integrated bobbin transformer assembly according to an embodiment of the present invention. The integrated bobbin transformer assembly 200 may include a first planar assembly 202, a magnetic core 210, a connecting assembly 204, and a second planar assembly 206. The first planar assembly 202 may include a first winding formed, for example, as a PWB layer as shown in FIG. 3E) and the connecting assembly 204 may include a second winding 208. The second winding 208 may be wrapped about the connecting assembly 204. In an embodiment of the invention, the second planar assembly 206 may include an additional first winding.

In an embodiment of the invention, an input voltage may be received at a first winding of the first planar assembly 202. The input voltage may be magnetically coupled to a second winding 208 utilizing a magnetic core 210 of the integrated bobbin transformer assembly 200 to create an output voltage. The output voltage may be output via the second winding to an external device, e.g., a rectifier utilized in a power supply. In an embodiment of the invention, the input voltage may also be received at the additional first winding of the second planar assembly 206. In this embodiment, the input voltage from both the first winding and the additional first winding may be magnetically coupled to the second winding 208 utilizing a magnetic core 210 of the integrated bobbin transformer assembly 200 to create an output voltage.

In an alternative operating environment, an input voltage may be received at a second winding 208, where the second winding 208 is wound about a connecting assembly 204. The input voltage may be magnetically coupled, utilizing the magnetic core 210 of the integrated bobbin transformer assembly 200, to the first winding of the first planar assembly 202 to create an output voltage. Additionally, the input voltage may be magnetically coupled, utilizing the magnetic core 210 of the integrated bobbin transformer assembly 200, to the additional first winding of the second planar assembly 206 to create the output voltage. The output voltage may be output via the first winding to an external device. Alternatively, the output voltage may be output via the first winding and the additional first winding to the external device.

The integrated bobbin transformer assembly 200 may be utilized to enhance the performance of small footprint transformer designs at almost any operating frequency and any power level. In embodiments of the invention, the integrated bobbin transformer may be utilized in applications where the frequency ranges from 250 Kilohertz to 400 Kilohertz and the power level is from 50 Watts to 350 Watts.

Figure 2B:
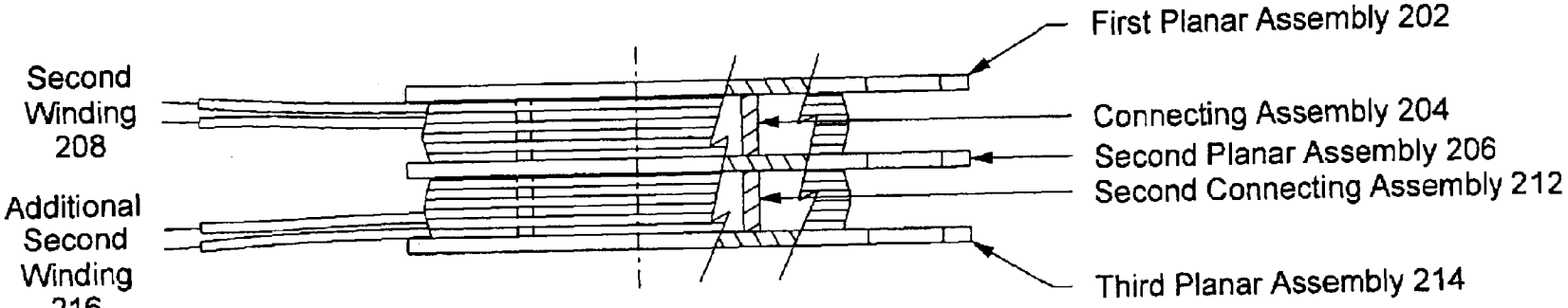
FIG. 2*b* illustrates a stackable integrated bobbin transformer assembly according to an embodiment of the present invention.

In an embodiment of the invention, the second winding 208 of the integrated bobbin power transformer assembly 200, illustrated in FIGS. 2 and 2*b*, may be wound about the connecting assembly 204. In this embodiment of the present invention, the first winding of the integrated bobbin transformer assembly 200 may be incorporated into the first planar assembly 202. In additional embodiments of the invention, an additional first winding of the integrated bobbin transformer assembly 200 may be incorporated into the second planar assembly 206.

In an embodiment of the present invention, the second winding wrapped about the connecting assembly 204 may be the primary winding of the integrated bobbin transformer assembly 200, and the first winding of the first planar assembly 202 may be the secondary winding of the integrated bobbin transformer assembly 200. In embodiments of the invention including an additional first winding in the second planar assembly 206, the first winding and the additional first winding may be the secondary windings of the integrated bobbin transformer assembly 200.

As illustrated by FIG. 2, the first planar assembly 202 and the second planar assembly 206 may be coupled utilizing a connecting assembly 204. The bobbin is the combination of the connecting assembly 204 and its integration into the first planar assembly 202 and the second planar assembly 206. The connecting assembly 204 preferably may be made of any known material that is any insulating material, such as polyamide, FR4, paper and plastic. The connecting assembly 204 material may withstand temperatures of 250 degrees Centigrade. The connecting assembly 204 may receive input voltage through input leads or may deliver an output voltage through output leads depending on whether the second winding about the connecting assembly 204 is a primary winding or a secondary winding. The input or output leads are connected to the primary or secondary windings through normal coupling techniques utilized in the art, e.g., soldering.

FIG. 2*b* illustrates a stackable integrated bobbin transformer assembly according to an embodiment of the present invention. An integrated bobbin transformer assembly 200 may include a plurality of planar assemblies and a plurality of connecting assemblies. For example, the integrated bobbing transformer assembly may include three planar assemblies and two connecting assemblies, or the integrated bobbin transformer assembly may include five planar assemblies and four connecting assemblies. In an embodiment of the present invention, the integrated bobbin transformer assembly may include a first planar assembly 202, a connecting assembly 204, a second planar assembly 206, a second connecting assembly 212, and a third planar assembly 214. The first planar assembly 202 may include a first winding (not shown); the second planar assembly 206 may contain an additional first winding (not shown), and the third planar assembly 214 may include a supplemental additional first winding (not shown). In other embodiments of the invention, an additional first winding may not be included in the second planar assembly 206, and/or the supplemental additional first winding may not be included in the third planar assembly 215.

The first connecting assembly 204 may include a second winding 208 and the second connecting assembly 212 may include an additional second winding 216. In this embodiment, if the second winding 208 and the additional second winding 216 are the primary windings of the integrated bobbin transformer assembly and the first planar assembly 202, the second planar assembly 206, and the third planar assembly 214 including windings, input voltage may be magnetically coupled 1) from the second winding 208 of connecting assembly 204 to the first winding of the first planar assembly 202 and the additional first winding of the second planar assembly 206 to create an output voltage and 2) from the additional second winding 216 of the second connecting assembly 212 to the additional first winding of the second planar assembly 206 and the supplemental additional first winding of the third planar assembly 214.

In an embodiment of the invention, the connecting assembly 204 height may be 0.102 inches or greater. In other words, the space between the first planar assembly 202 and the second planar assembly 206 may be 0.102 inches or greater. In embodiments of the present invention, the connecting assembly 204 may be bonded to the first planar assembly 202 and the second planar assembly 206 by compositions known in the art, e.g., SuperGlue™, Locktite Impruv™, and WeldBond™. Any bonding composition may be utilized; the choice of bonding composition depending on the application in which the integrated bobbin transformer assembly 200 is being utilized.

In an alternative embodiment of the invention, the integrated bobbin transformer may be manufactured as a unitary one piece assembly, including a first planar portion, a second planar portion, and a connecting portion. In external appearance, the unitary one piece integrated bobbin transformer may look the same as the integrated bobbin transformer assembly 200 but it may be originally constructed of one printed wiring board. In this embodiment, a hole or opening may be created, e.g., by a drill, in the unitary one piece integrated bobbin transformer to create space for the magnetic core of the integrated bobbin transformer. In an embodiment of the invention, the hole may be created in the center of the first planar portion, the second planar portion, and the connecting portion.

In an embodiment of the invention, the connecting assembly 204 may have a square shape. In other embodiments of the invention, the connecting assembly 204 may have a rectangular shape, a circular shape, or a hexagonal shape. The connecting assembly 204 may be any shape that facilitates coupling of the primary winding and the secondary winding and/or allows easier integration of the connecting assembly 204 into the first planar assembly 202 and the second planar assembly 206.

Figure 3:
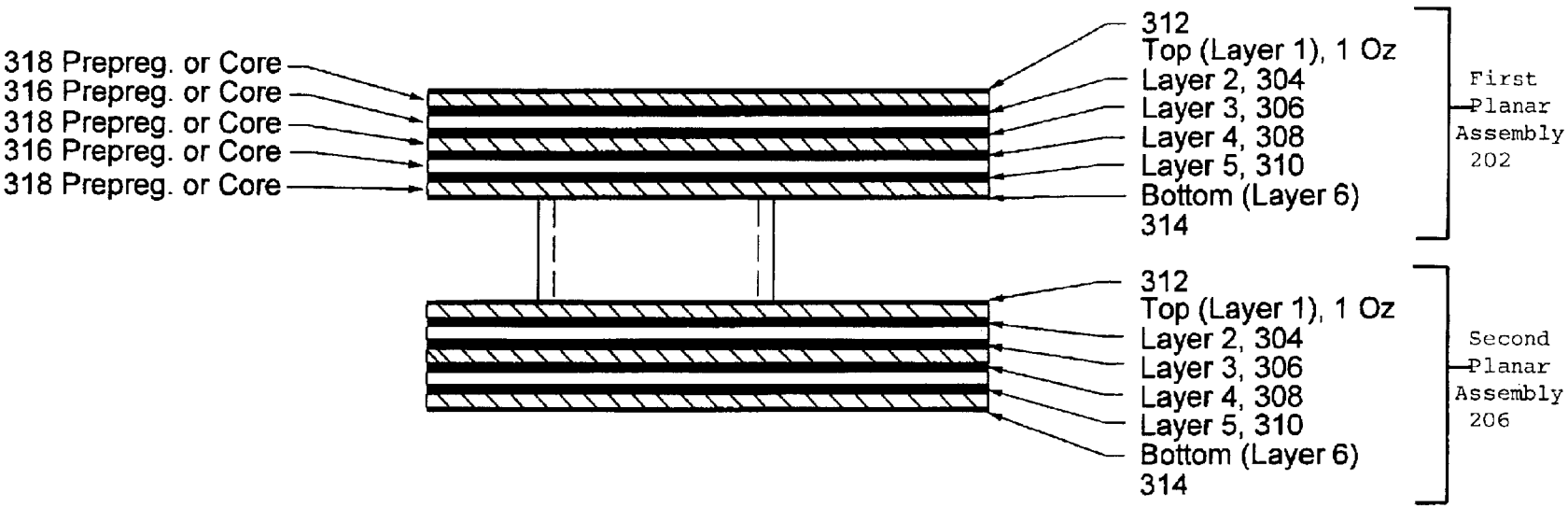
FIG. 3 illustrates a plurality of layers of a first planar assembly and the second planar assembly according to an embodiment of the present invention.

FIG. 3 illustrates a plurality of layers of a first planar assembly 202 and the second planar assembly 206 according to an embodiment of the present invention. The first planar assembly 202 and the second planar assembly 206 may each be a printed wiring board (PW13), where each PWB consists of a plurality of PWB layers, e.g., the first planar assembly 202 may include PWB layer 2 304, PWB layer 3 306, PWB layer 4 308, and PWB layer 5 310. The construction of the PWB generally involves the use of a top layer 312 and bottom layer 314, which is usually conductive, and multiple PWB layer in between the top layer 312 and the bottom layer 314. The first planar assembly 202 and the second planar assembly 206 are constructed so as to place an insulating material between the multiple conductive layers. In embodiments of the invention, the insulating material may be a pre-impregnated, i.e., prepeg, material or the insulating material may be a core material. The decision as to the type of insulating material may depend on the application in which the integrated bobbin transformer assembly is being utilized.

As discussed previously, in one embodiment of the present invention, the first planar assembly 202 and the second planar assembly 206 may contain the secondary findings of the integrated bobbin transformer assembly 200. Alternatively, only one of the first planar assembly 202 and the second planar assembly 206 may contain the secondary windings of the integrated bobbin transformer assembly 200. In an alternative embodiment, the first planar assembly 202 and the second planar assembly 206 may contain the primary windings of the integrated bobbin transformer assembly 200. Altematively, one of the first planar assembly 202 and the second planar assembly 206 may contain the primary windings of the integrated bobbin transformer assembly 200. Each of the plurality of PWB layers 304 306 308 and 310 may include a known PWB material, such as polyamide or paper, and a conducting material, e.g., copper etched into the PWB material.

Figure 4C:
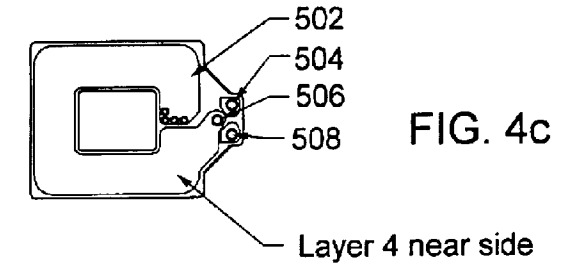
FIGS. 4*a*, 4*b*, 4*c*, 4*d*, and 4*e* illustrate a plurality of PWB layers according to an embodiment of the present invention.
Figure 4D:
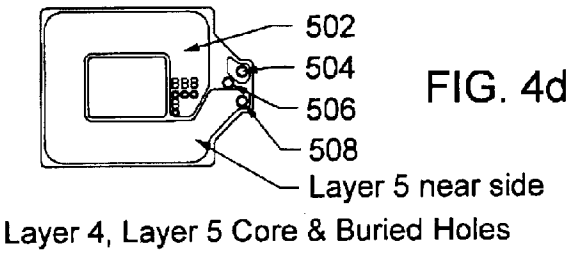
Figure 4A:
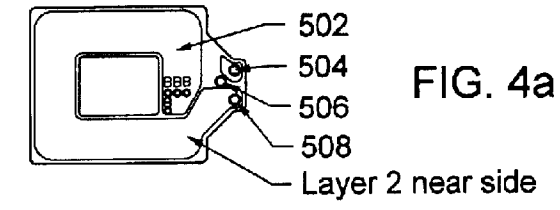
Figure 4B:
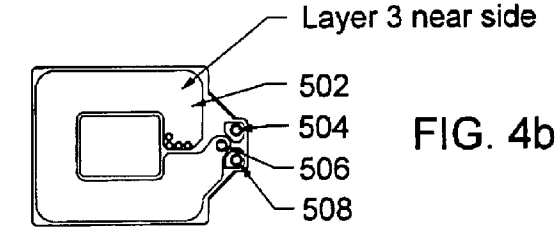
Figure 4E:
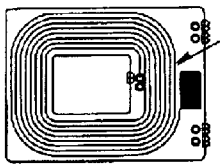

The conducting material may represent a turn or a portion of a turn of either the primary or secondary windings of the integrated bobbin transformer assembly 200. For example, each of the plurality of PWB layers 304, 306, 308, and 310 may include a portion of a turn, i.e., ¼ of a turn of the primary winding or secondary winding. In other embodiments of the present invention, each of the plurality of PWB layers 304, 306, 308, and 310 may include multiple turns of the primary winding or secondary winding. Illustratively, FIGS. 4*a*, 4*b*, 4*c*, and 4*d* represent a PWB layer, e.g., PWB layer 2 304, with one turn 502 of a secondary winding FIG. 4*e* illustrates a PWB layer with eight turns 510 of a secondary winding. In embodiments of the present invention, a PWB layer may not include a winding or turn, specifically if the PWB layer is located in a first planar assembly 202 or a second planar assembly 206 that does not include a first to winding or an additional first winding, respectively.

In an embodiment of the present invention, the plurality of PWB layers 304, 306, 308, and 310 may illustratively, include a copper plating having a thickness in the range 3–4 thousandths of an inch, i.e., 0.003–0.004 inches. In an embodiment of the present invention, the top layer 312 and the bottom layer 314 may, illustratively, include a copper plating having a thickness of about 1 thousandth of an inch, i.e., 0.001 inch.

The first planar assembly 202 and the second planar assembly 206 may each include a top layer 312 and a bottom layer 314, as illustrated in FIG. 3. The top layer 312 and the bottom layer 314 may provide a surface to house pins that are soldered to the first planar assembly 202 and the second planar assembly 206. In general, the pins may provide the connection with the input power device (not shown) or the power receiving device (not shown), depending on whether the first planar assembly 202 and the second planar assembly 206 include the primary winding or the secondary winding of the integrated bobbin transformer assembly 200.

In an embodiment of the present invention illustrated in FIG. 3, a prepreg layer 318 may be included/disposed between the top layer and one of the plurality of PWB layers, e.g., layer 2, in between two of the plurality of PWB layers, e.g., layer 3 306 and layer 4 308, and between one of the plurality of PWB layers, e.g., layer 5 and the bottom layer 314. The prepreg layers 318 may, illustratively, have a width of 0.002 inches or greater.

In this embodiment of the invention, an insulating material or core layer 316 may be installed/disposed between two of the plurality of PWB layers, e.g., in between layer 2 304 and layer 3 306 and in between layer 4 308 and layer 5 310. The core layers may, illustratively, have a width of 0.001 inches or greater.

FIGS. 4*a*, 4*b*, 4*c* and 4*d* illustrate the plurality of PWB layers, layer 2 304, layer 3 306, layer 4 308, and layer 5 310. For ease of discussion, due to the similarities of the plurality of PWB layers, only one PWB layer, i.e., layer 2 304 is described. PWB layer 2 304 may include a turn or a portion of a transformer winding 502 and a plurality of pin holes 504, 506, and 508. The plurality of pin holes 504, 506, and 508 may allow the connection of the windings between the plurality of PWB layers, e.g., between layer 2 304 and layer 3 306. The plurality of pin holes 504, 506, and 508 may also allow the connecting of the windings of the plurality of PWB layers to the top layer 312 or the bottom layer 314. More specifically, the plurality of pin holes 504, 506, and 508 may connect to the input power device or the power receiving device, e.g., rectifier, entering into or exiting out of the integrated bobbin power transformer assembly 200.

The plurality of PWB layers 304, 306, 308, and 310 may be coupled in various combinations. For example, the plurality of PWB layers 304, 306, 308, and 310 may be coupled in parallel or in serial. Additionally, the first planar assembly 202 and the second planar assembly 206 may also be coupled either in a parallel fashion or a serial fashion.

Illustratively, in one embodiment of the invention, the plurality of PWB layers 304, 5 306, 308, and 310 may each include one turn and may be connected in series to form four turns. In this embodiment of the invention, the first planar assembly 202 and the second planar assembly 206, may each include four turns, and may be connected in parallel. In this embodiment, the secondary primary windings in the first planar surface and the second planar surface may form four turns.

In alternative embodiments of the invention, the plurality of PWB layers 304, 306, 308, and 310 may be connected in parallel forming only the number of turns that each layer may have deposited on it or included on it. In these embodiments of the invention, the turns may have a larger amount of material, e.g., copper, which may reduce the loss of the integrated bobbin power transformer assembly. For example, the plurality of PWB layers 304, 306, 308, and 310 of a first planar assembly 202 and of a second planar assembly 206 may each include two turns and may be connected in parallel. Thus, the first planar assembly 202 and the second planar assembly 206 may each include two turns. In this embodiment, if the first planar assembly 202 and the second planar assembly 206 are coupled in parallel, the number of turns may be two turns. If the first planar assembly 202 and the second planar assembly 206 are coupled in series, the number of turns may be four turns.

While the description above refers to particular embodiments of the present invention, it will be understood that many modifications may be made without departing from the spirit thereof. The accompanying claims are intended to cover such modifications as would fall within the true scope and spirit of an embodiment of the present invention. The presently disclosed embodiments are therefore to be considered in all respects as illustrative and not restrictive, the scope of an embodiment of the invention being indicated by the appended claims, rather than the foregoing description, and all changes that come within the meaning and range of equivalency of the claims are therefore intended to be embraced therein.

What is claimed is:

1. A transformer assembly, comprising:

a first planar assembly including a first winding;

a second planar assembly separated from the first planar assembly by a non-conductive connecting assembly; and wherein the connecting assembly comprises a bobbin for a second winding, the connecting assembly is integrated into the first planar assembly and the second planar assembly, the second winding is wound about the connecting assembly, and the second winding is magnetically coupled to the first winding.

2. The transformer assembly of claim 1, wherein the first winding is a secondary winding of the transformer assembly and the second winding comprises wire wound around the connecting assembly and is a primary winding of the transformer assembly.

3. The transformer assembly of claim 1, wherein the first winding is a primary winding of the transformer assembly and the second winding comprises wire wound around the connecting assembly and is a secondary winding of the transformer assembly.

4. The transformer assembly of claim 1, wherein the second planar assembly includes an additional first winding and the second winding is magnetically coupled to the additional first winding.

5. The transformer assembly of claim 4, wherein the first winding on the first planar assembly and the additional first winding on the second planar assembly are connected in series.

6. The transformer assembly of claim 4, wherein the first winding on the first planar assembly and the additional first winding on the second planar assembly are connected in parallel.

7. The transformer assembly of claim 4, further including a magnetic core to magnetically couple the second winding to the first winding and the additional first winding.

8. The transformer assembly of claim 1, wherein the first planar assembly and the second planar assembly each include a plurality of printed wiring board (PWB) layers.

9. The transformer assembly of claim 8, wherein the plurality of PWB layers includes a first winding or an additional first winding.

10. The transformer assembly of claim 8, wherein at least one of the plurality of PWB layers include a first winding and a second of the plurality of PWB layers includes an additional first winding.

11. A transformer, comprising:

a first planar portion including a first winding;

a second planar portion;

a connecting assembly including a second winding; and a magnetic core in the connecting assembly;

wherein the connecting assembly is integrated into the first planar portion and the second planar portion, the second winding is wound about the connecting assembly, the second winding is magnetically coupled to the first winding by the magnetic core in the connecting assembly, and the first planar portion, the second planar portion, and the connecting portion are formed in a unitary printed wiring board.

12. The transformer of claim 11, further including a hole in the unitary printed wiring board for the magnetic core.

13. The transformer of claim 12, wherein the hole is in the center of the unitary printed wiring board.

14. The transformer of claim 11, wherein the second planar portion includes an additional first winding and the additional first winding is magnetically coupled to the second winding by the magnetic core.

* * * * *